United States Patent [19]

Cameron et al.

[11] Patent Number: 4,588,109

[45] Date of Patent: May 13, 1986

[54] ADHESIVE SUPPLYING SYSTEM

[75] Inventors: Ewen R. Cameron, Oadby; Robert Yardley, Thurmaston; Frank H. Wolloff, Birstall, all of England

[73] Assignee: USM Corporation, Farmington, Conn.

[21] Appl. No.: 705,086

[22] Filed: Feb. 25, 1985

[30] Foreign Application Priority Data

Feb. 25, 1984 [GB] United Kingdom ..... 8404965

[51] Int. Cl.[4] ..... B67D 5/00

[52] U.S. Cl. ..... 222/63; 222/146.2; 222/375; 222/638; 141/116

[58] Field of Search ..... 222/146.2, 146.5, 333, 222/372, 375, 383, 571, 108, 109, 52, 148, 318, 63, 638; 141/115, 116, 119; 118/410; 417/411

[56] References Cited

U.S. PATENT DOCUMENTS 2,605,025 7/1952 Cozzoli ..... 222/375

3,779,426 12/1973 Mawby ..... 222/146.5 X 3,895,748 7/1975 Klingenberg ..... 141/119 X 3,942,686 3/1976 Roth ..... 222/146.5

4,119,058 10/1978 Schmermund ..... 222/571 X

*Primary Examiner*—Joseph J. Rolla

*Assistant Examiner*—David H. Bollinger

*Attorney, Agent, or Firm*—William F. White

[57] ABSTRACT

In a thermo-cementing and folding machine which has a suck-back facility, by which at the end of an adhesive-applying operation adhesive supplied through the nozzle (22) is sucked back into the nozzle so as to prevent 'drooling', auxiliary suck-back steps are introduced at timed intervals following the primary suck-back operation, through controlled amounts, in order to counter further risk of 'drooling' caused by thermal expansion of the adhesive in the nozzle (22). The number of auxiliary suck-back steps is variable according to the adhesive supply rate at the time of termination of the adhesive-applying operation.

9 Claims, 6 Drawing Figures

MI
E
S5
R
C
RAM
CPU
DB
EPROM
D
I/P
ADC
I/O B
O/P
TS1
TS2
TS3
VR4
VR5
VR6
S4
S6
S7
S8
H1
H2
H3
M
SMD
SOL1
SOL2
RL1

| INDEX | DELAY (SECS) |
|---|---|
| 1 | 3 |
| 2 | 3 |
| 3 | 6 |
| 4 | 6 |
| 5 | 6 |

| INDEX | NO. OF STEPS |
|---|---|
| 1 | 2 |
| 2 | 2 |
| 3 | 2 |
| 4 | 1 |
| 5 | 1 |

ADHESIVE SUPPLYING SYSTEM

FIELD OF THE INVENTION

This invention relates to an adhesive supply system and more particularly to a system for supplying hot melt adhesive.

BACKGROUND OF THE INVENTION

Systems for supplying hot melt adhesive is rendered molten, a nozzle through which molten adhesive is supplied from the melt chamber by means of the pump, and heating means for maintaining the nozzle at an appropriate temperature for ensuring that the adhesive in the nozzle remains molten not only during an adhesive-applying operation but also between successive such operations, wherein, at the end of an adhesive-applying operation, the molten adhesive in the nozzle is caused to be sucked back thus to avoid drooling of adhesive from the nozzle.

One such system is described in our co-pending European Patent Application No. 83306752.3, for use in a so-called thermo-cementing and folding machine. It has been found, however, that despite the provision of a suck-back facility, if a next cycle of operation of the machine in question is not initiated within a reasonable time of the termination of the preceding cycle, then 'drooling' of adhesive from the nozzle may nevertheless occur.

Examination of this problem has led to the consideration that whereas the initial or primary suck-back is effective to overcome the pressure creating the adhesive flow and to suck back into the nozzle the relatively large amount of adhesive which is collected about the nozzle outlet at the end of the adhesive-applying operation, nevertheless thermal expansion of the adhesive in the nozzle may take place when the adhesive remains for longer periods in contact with the nozzle, which is heated. Increasing the amount of adhesive initially sucked back in order to accommodate such expansion increases the risk, however, that air will also be drawn into the system with consequent detriment to the satisfactory operation of the system, which should provide a reliably uniform supply of adhesive to workpieces being coated.

OBJECT OF THE INVENTION

It is therefore an object of the present invention to provide an improved adhesive supply system in which 'drooling' of adhesive from the nozzle can be prevented or minimised without running the risk of air being drawn into the system with consequent detriment to the satisfactory operation of the system.

SUMMARY OF THE INVENTION

The above and other objects are accomplished in accordance with the present invention, by an adhesive supply system having a control means which allows certain further adhesive suck-back to take place. This adhesive suck-back occurs over controlled distances in a succession of auxiliary suck-back steps which are spaced apart by pre-selected intervals starting at the end of the primary adhesive suck-back operation.

By thus providing a succession of auxiliary suck-back steps, it will be appreciated, the adhesive in the nozzle can be more readily maintain at or adjacent the nozzle outlet preventing drooling therefrom on the one hand, and on the other avoiding any tendency to draw air into the system. In particular, it has been found that the meniscus formed by the adhesive at the nozzle outlet will not fall from the nozzle unless either it becomes sufficiently large to break the surface tension or it comes into contact with another surface, e.g. a workpiece support surface. In the case of a thermo-cementing and folding machine, for example, a so-called work release is provided, which is operable in co-operation with the under-side of a creaser foot (constituting the nozzle) to prevent the workpiece from being moved in a reverse direction during the return movement of the workpiece feeding means (constituted by an orbitally operating hammer-and-anvil arrangement) of the machine. Thus, when the last-mentioned arrangement is 'open', for its return movement, the work release is 'up' so that, when the machine is inoperative, the work release occupies a position close the creaser foot with the consequent risk that the adhesive in the nozzle, by expansion, may contact the work release surface. It is of course most desirable to avoid adhesive on said surface, since the latter contacts parts of a workpiece which are likely to be exposed in view in the finished article.

From the foregoing it will further be appreciated that the temperature of the adhesive in the nozzle will depend to a large extent upon the rate at which it flows through the nozzles and that consequently the amount of expansion which can take also depends upon said flow rate. In the adhesive supply system in accordance with the present invention, therefore, preferably the number of auxiliary suck-back steps is determined according to the rate of delivery of the pump at the end of the adhesive-applying operation. In the specific embodiment described hereinafter two pre-set numbers of steps are selected from according to whether or not such flow rate is less than or not less than a specified proportion of the maximum. It will however be appreciated that any appropriate correlation between the number of steps selected and the actual flow rate may be utilised, the appropriate criterion being that the adhesive in the nozzle achieves stability, that is to say that such adhesive has reached a stable temperature and further expansion will not take place.

In general, of course, it will be expected that, in the normal course of use, a next adhesive-applying operation will be initiated before all the suck-back steps have been performed, such initiation overriding the control means.

The controlled distances through which the adhesive is caused to be sucked back in the auxiliary suck-back steps may be at the discretion of the operator. However, where the characteristics of adhesives likely to be used in the system do not greatly vary, such distances are preferably pre-set.

The timing of the auxiliary suck-back steps may likewise be at the discretion of the operator in order to achieve optimum operating conditions for all adhesive, but again where characteristics do not greatly vary, pre-set intervals may be used to advantage. In a preferred embodiment, the intervals are pre-set, the initiation of each successive auxiliary suck-back step being timed from the end of the preceding suck-back step.

It will also be appreciated that the more nearly the adhesive in the nozzle approaches a stable condition either the more spaced apart the auxiliary suck-back steps may become or the less the controlled distance through which the adhesive is sucked back or both. Thus in the adhesive supply system in accordance with the invention preferably the later ones of the intervals by which the auxiliary suck-back steps are spaced apart are of greater duration than the earlier ones. In addition, the controlled distances through which auxiliary suck-back takes place as aforesaid in earlier auxiliary suck-back steps are preferably greater than in later such steps.

In a more specific form, the invention also provides an adhesive supply system for hot melt adhesive, comprising a reversible pump, a melt chamber in which adhesive is rendered molten, a nozzle through which molten adhesive is supplied from the melt chamber by means of the pump, and heating means for maintaining the nozzle at an appropriate temperature for ensuring that the adhesive in the nozzle remains molten not only during an adhesive-applying operation but also between successive such operations, wherein, at the end of an adhesive-applying operation, the pump is operated in reverse direction whereby to cause the molten adhesive in the nozzle to be sucked back thus to avoid drooling of adhesive from the nozzle, and further wherein control means is provided whereby the pump is thus operated in reverse direction through controlled distances in a succession of in auxiliary suck-back steps spaced apart by pre-selected intervals starting at the end of the primary adhesive suck-back operation.

It will be appreciated that by the use of a reversible pump, a compact readily controllable arrangement is provided for achieving the desired suck-back of the adhesive in the nozzle. One such pump is of course a gear pump.

Conveniently, furthermore, the pump is driven by an n.c. motor (as hereinafter defined) and the control means comprises a computer control which serves to control the incidence of the operations of the motor in reverse direction and the duration of all such operation using appropriate look-up tables. (By the phrase "n.c. motor", where used herein, is to be understood a motor the operation of which is controlled by control pulses supplied thereto in accordance with digitised information appropriate to the desired operation of the motor. Examples of such motors are stepping motors and d.c. servo motors.) Furthermore, in such a system conveniently the computer control determines the number of operations of the motor in reverse direction according to the rate of operation of the pump at the end of the adhesive-applying operation.

It will thus be appreciated that in one form the invention is especially suited to computer control, although of course in its broader aspects other forms of control are to contemplated.

BRIEF DESCRIPTION OF THE DRAWINGS

There now follows a detailed description, to be read with reference to the accompanying drawings, of one adhesive supply system in accordance with the present invention, which system forms part of a thermo-cementing and folding machine. It is to be understood, however, that the system has been selected merely by way of the exemplification of the present invention and not by way of limitation thereof and in particular is not be understood as being restricted to use in thermo-cementing and folding machines.

In the accompanying drawings.

DESCRIPTION OF THE PREFERRED EMBODIMENT

Figure 1:
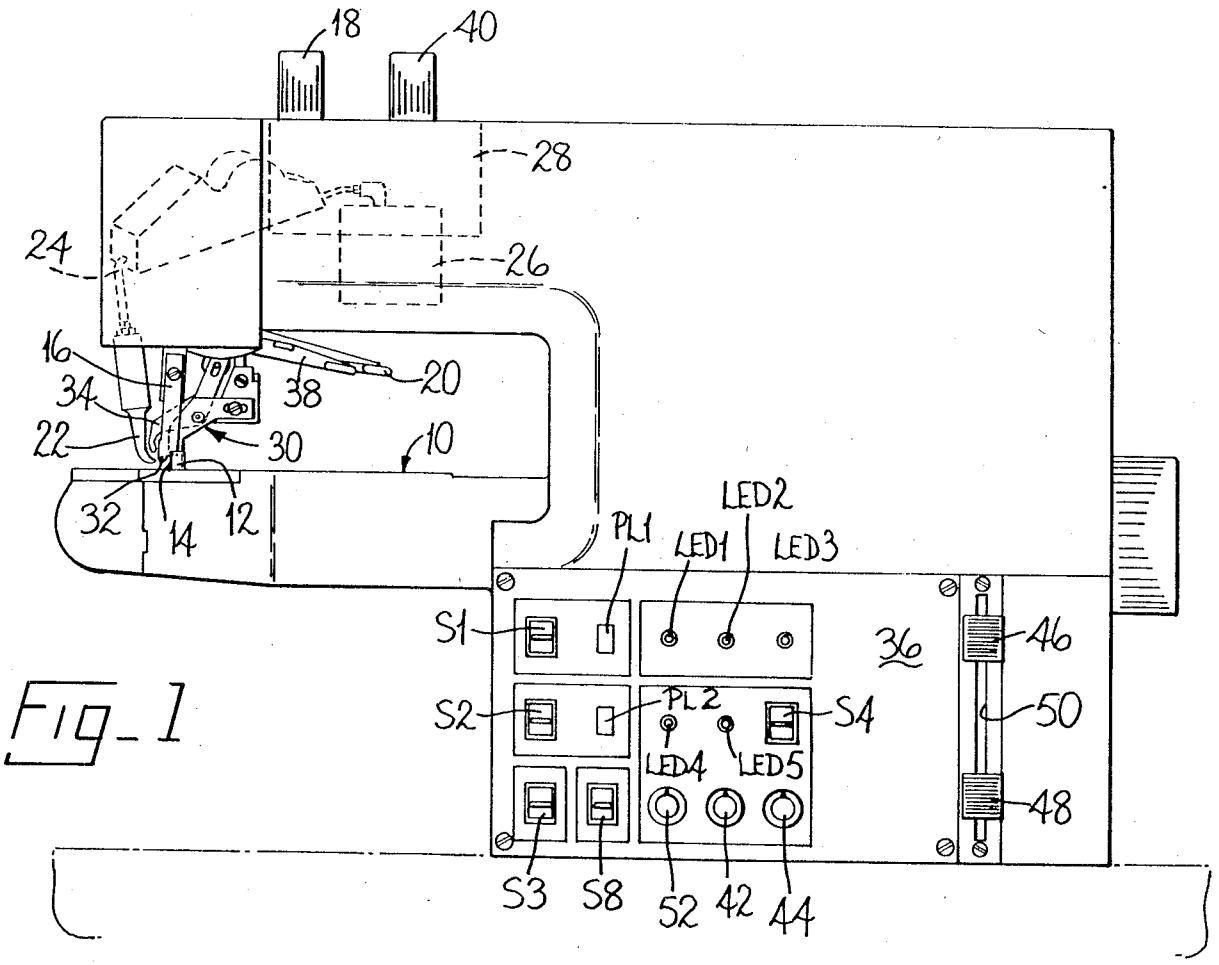
FIG. 1 is a front view of the thermo-cementing and folding machine incorporating the adhesive supply system in accordance with the present invention.

The adhesive supply system will now be described as it forms part of a thermo-cementing and folding machine, which machine finds use in the shoe industry and allied trades, where it is described to fold the edge of the workpiece over on itself and secure it in a folded condition. To this end, the machine comprises a work table 10 on which is supported a block 12 having a work-guiding surface 14 which curves upwardly, out of the plane of the work table 10, so as to provide a smooth fold-initiating surface for a workpiece the edge of which is to be folded. For limiting the movement of the workpiece edge of the surface 14, a gauge finger 16 is provided which is adjustable heightwise by means of an adjustment knob 18. For raising the gauge finger 16 out of its operative position, furthermore, a manually operable lever 20 is provided.

For assisting in the formation of a fold, furthermore, a creaser foot 22 (which also constitutes a nozzle of the adhesive supply system in accordance with the present invention) is mounted with its end adjacent the block 12. The creaser foot has a central passage through which hot-melt adhesive can be fed, the foot having an outlet through which adhesive can be fed on to the central region of the part of the workpiece to be folded. The passage in the creaser foot is supplied through a delivery tube 24 which is connected "upstream" to a gear pump 26 which in turn is fed from a melt chamber 28. Because the adhesive is a hot-melt, the melt chamber 28, delivery tube 24 and creaser foot 22 are each provided with a separate heater, respectively H1, H2 and H3, of the electric cartridge type. The delivery tube, furthermore, is clad with appropriate thermal insulation.

For moving the creaser foot 22 out of its operative position a manually operable lever 38 is provided which, together with the lever 20, thus facilitates the introduction of a workpiece to the operating locality of the machine. The heightwise position of the creaser foot 22 is adjustable by an adjustment knob 40.

The machine, as so far described above, is conventional. Furthermore, also as is conventional, the machine comprises a snipping knife arrangement generally designated 30 and comprising a fixed blade 32 and a movable blade 34 mounted on the fixed blade, the blades being so arranged, "downstream" of the block 12, that they can cut the upstanding edge portion of the workpiece which is supported by the block 12. In general, the snipping knife arrangement 30 is used where the edge of the workpiece defines a so-called "inside" curve.

For feeding a workpiece past the block 12 and the creaser foot 22, and also for completing and consolidating the fold, a work feed arrangement is provided comprising a hammer-and-anvil (not shown) which are moved orbitally, the arrangement being such that over a given part of the orbit, the hammer-and-anvil trap the workpiece therebetween as they move rearwardly over a given distance (feed length) and at a given speed (feed speed). The hammer-and-anvil are driven through a main drive shaft (not shown) of the machine, by means of an electric motor (not shown) through a clutch. The motor speed, and thus the feed speed, is controlled by a first treadle (not shown); a second treadle (also not shown) also is provided for operating two switches S6, S7, the arrangement being such that only one of said switches can be operated at any one time. Switch S6 is effective to reduce the feed length, which thereby causes pleating of the folded over margin of the workpiece (and is thus especially useful on sharp so called "outside" curves). For controlling the feed length, "maximum" and "minimum" stops 46, 48 are provided, said stops being arranged to project through an appropriate slot 50 in the control panel to facilitate operator setting thereof. Switch S7 is effective to cause the snipping knife arrangement 30 to operate.

For switching the supply of adhesive on and off, a main switch S4 is provided on a control panel 36 of the machine, and, for controlling the supply of adhesive during the operation of the machine, a knee-operated switch S5 is provided.

The control panel 36 of the machine has, in addition to the main "adhesive supply" switch S4, a mains on-off switch S1 and a motor on-off switch S2. Mains power is thus supplied to two solenoids SOL1, SOL2 and to heaters H1, H2, to be referred to hereinafter, and also to a transformer (not shown) which steps down the voltage to 12 volts. A 12 V a.c. supply is thus supplied to a work lamp (not shown) which can be switched on by switch S3, also on the control panel 36. In addition, this circuit supplies power to a further heater H3. From this 12 V. a.c. circuit, furthermore, is derived an unsmoothed 12 volt d.c. circuit which supplies power to a mains-controlled control box MI supplying a "mains interrupt" signal to be referred to hereinafter. In addition, there is derived from the 12 V a.c. circuit a smoothed 12 V d.c. circuit which supplies power to an n.c. motor M (in casu a stepping motor), which will be referred to hereinafter. From the smooth 12 V d.c. circuit, furthermore, is derived a 5 V circuit, which drives a central processor unit (CPU) and circuits, and supplies power to switches S4, S5, S6 and S7 thermisters TS1, TS2, TS3 and potentiometers VR4, VR5 and VR6, each of which will be referred to hereinafter.

The control panel 36 also is provided with various indicator devices, including a light-emitting diodes LED 1, LED 2 and LED 3, associated respectively with heaters H1, H2 and H3, and LED 4 and LED 5, associated respectively with an "adhesive supply" circuit and with the knee-operated switch S5, also as to be described in detail later.

As already mentioned, switches S6 and S7, which are operated under the control of the second treadle of the machine, cannot be operated simultaneously, the one switch being operated by depression of the toe of the operator on the treadle, and the other by depression of his or her heel. In some cases, however, it is desirable that snipping should take place while the feed length is reduced, and to this end a further control switch S8 is provided on the control panel 36 which is effective, in combination with switch S6, to cause snipping to take place simultaneously with the reduced feed length.

Figure 2:
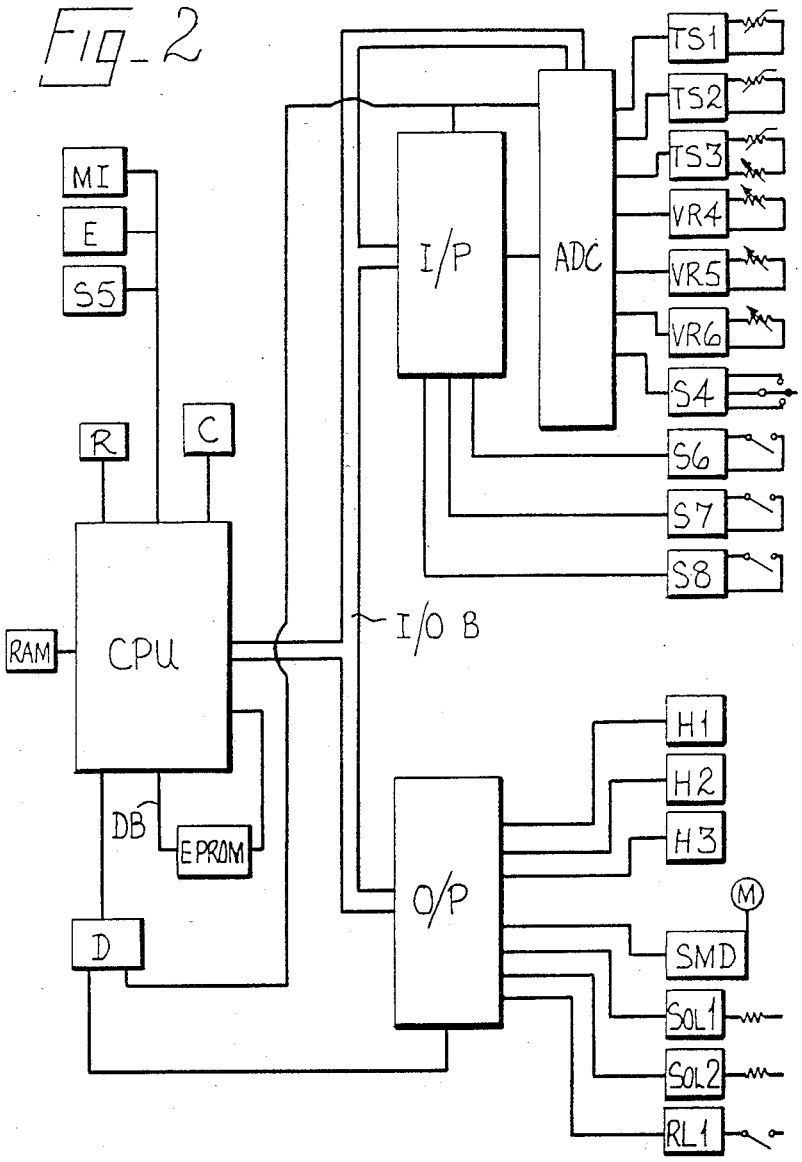
FIG. 2 is a block diagram of an electronic control circuit of said machine (and thus of said system)

The machine in accordance with the invention is computer-controlled and comprises a central processor unit (CPU) in the form of a single chip 8-bit micro-computer (in casu, a Zilog Z8681 which, in addition to a micro-processor, also incorporates a random access memory (RAM) (shown separately in FIG. 2) and scratch pad; this micro-computer is obtainable from Zilog Inc.). For the internal timing of the CPU a system clock C, comprising a free-running 8 MHZ crystal, is provided.

The CPU is connected via I/O bus I/OB with input and output ports IP, OP and via a memory address and data bus DB with a non-volatile memory in the form of an EPROM (erasable programmable read-only memory), which is accessed by the CPU via the data bus DB for instructions to execute. A conventional decoder D is also provided for controlling the functioning of the input and output ports IP, OP.

The control circuit also includes an analogue-to-digital converter (ADC) to which signals are supplied by the potentiometers VR4, VR5, VR6, thermisters TS1, TS2, TS3, and switches S4, S8. The ADC is interrogated by the CPU, by the I/O bus, each time a mains interrupt signal is supplied to the CPU by the control box MI. More particularly, the various channels of the ADC are interrogated in turn, one in response to each mains interrupt in a so-called "wrap around" sequence. The ADC, in response to a signal from the decoder D, supplies information as to the state of the interrogated channel via the input port IP.

Also supplying information via the input port in response to an enabling signal from the decoder D, are switches S6, S7, while switch S5 provides a direct "interrupt" signal to the CPU.

The electronic control circuit also comprises a re-set sub-circuit R by which, upon starting up of the machine, the CPU is enabled to set the controls to their correct state in a rapid manner. This sub-circuit R is directly connected into the CPU for this purpose.

A further, direct, "interrupt" input is provided to the CPU from a shaft encoder E which is driven by the main drive shaft of the machine. The shaft encoder E is conveniently a disc having a plurality of (in casu sixteen) equally spaced notches, with which are aligned two opto-switches operating through a flip-flop (set/reset) to supply pulses to the CPU. The switches are spaced apart from one another by a distance more than the width of a notch, so that if, for example, the main drive shaft is arrested in a position in which the edge of a notch is aligned with one of the switches, any vibration of the disc, e.g. caused by vibrations of the machine, will not result in the generation and supply to the central processing unit of a series of pulses, but rather that switch, having once emitted a pulse, will be disabled until the flip-flop is re-set by the other switch having been actuated.

In response to the various signals thus applied to the CPU, the CPU supplies outputs, via output port OP, to sub-circuits controlling the heaters H1, H2, H3, to sub-circuits controlling the solenoids SOL1, SOL2, to motor drive SMD and to the various LEDs referred to above.

The n.c. motor M is operatively connected to the gear pump 26 and serves to control the rate of feed of adhesive through the adhesive-supply system. To this end, switch S4, which is a three-position switch, is provided for manually switching the adhesive supply system on and off; the third position will be referred to later. Switch S4 is an overall control for switching at the start and finish of a working shift. In addition, knee-operated switch S5 is provided for switching the system on and off in each working cycle. Both switches S4, S5 serve, through the CPU, to switch motor M on and off.

The operating speed of the motor M is controlled by the shaft encoder E, as will now be described. Thus, in response to each pulse generated by the shaft encoder E, a digital "increment" value is added to an accumulator stored in the RAM of the CPU. This increment value is determined by an operator setting of the potentiometer VR4, which is provided with an adjustment knob 42 on the control panel 36 for this purpose. The potentiometer VR4 forms part of a metering circuit which supplies a signal through the ADC to the CPU. The range of adjustment of the potentiometer VR4 corresponds to a range of ratios of rotation of the main drive shaft to rotation of the motor M. In the machine described, the range of ratios is approximately 40:1 to 400:1 and this range of ratios corresponds to an output from the ADC of 225 to 0 (FF to 0 hex). The value of the signal from the ADC constitutes the increment value. The accumulator adds the increment value to the accummulated total in response to each pulse from the shaft encoder, and each time the accumulator, "overflows", the motor M receives a drive pulse; in the case of a stepping motor, it is stepped through one step.

It will thus be appreciated that, by altering the position of adjustment knob 42, the rate of feed of adhesive in relation to the rotational speed of the shaft can be adjusted by the operator.

In a thermo-cementing and folding machine, as mentioned above, it is sometimes desirable to reduce the feed length, irrespective of the feed speed, in order to steer round "outside" curves. To this end, as is conventional, solenoid SOL1 is provided which switches the feed length between maximum and minimum as determined by the stops 46, 48, referred to above. More particularly, as is conventional, the solenoid SOL1 serves to cause the geometry of a linkage system to be so varied as to consequently vary also the distance through which the hammer-and-anvil move in feeding the workpiece. In the machine in accordance with the invention, solenoid SOL1 is operated by actuation of treadle-operated switch S6.

Reducing the feed length is of course effective to reduce the rate at which the workpiece is fed through the machine, but without reducing the feed speed, as measured at the main drive shaft, so that the amount of adhesive fed is not generally affected by a reduction of feed length. This can lead to excessive adhesive being supplied, which adhesive may of course be squeezed from beneath the fold, leaving an unsightly amount of adhesive visible in the finished workpiece. To overcome this problem therefore, a "metering modify" circuit is provided which supplies an appropriate signal through the input port. This circuit operates in combination with the "metering" circuit and with the circuit incorporating the switch S6 so that, upon operation of the switch S6, the increment value referred to above is reduced, thereby reducing the frequency of "overflow" of the accumulator, and thereby increasing the ratio between the main drive shaft and the output shaft of the motor M. It has been found that a reduction of 50% of the increment value is appropriate when operating with reduced feed length.

For enabling the "metering modify" circuit, switch S4 is provided with contacts which are closed when in its third position. Of course, in the third position, the adhesive supply is still switched "on".

Figure 3A:
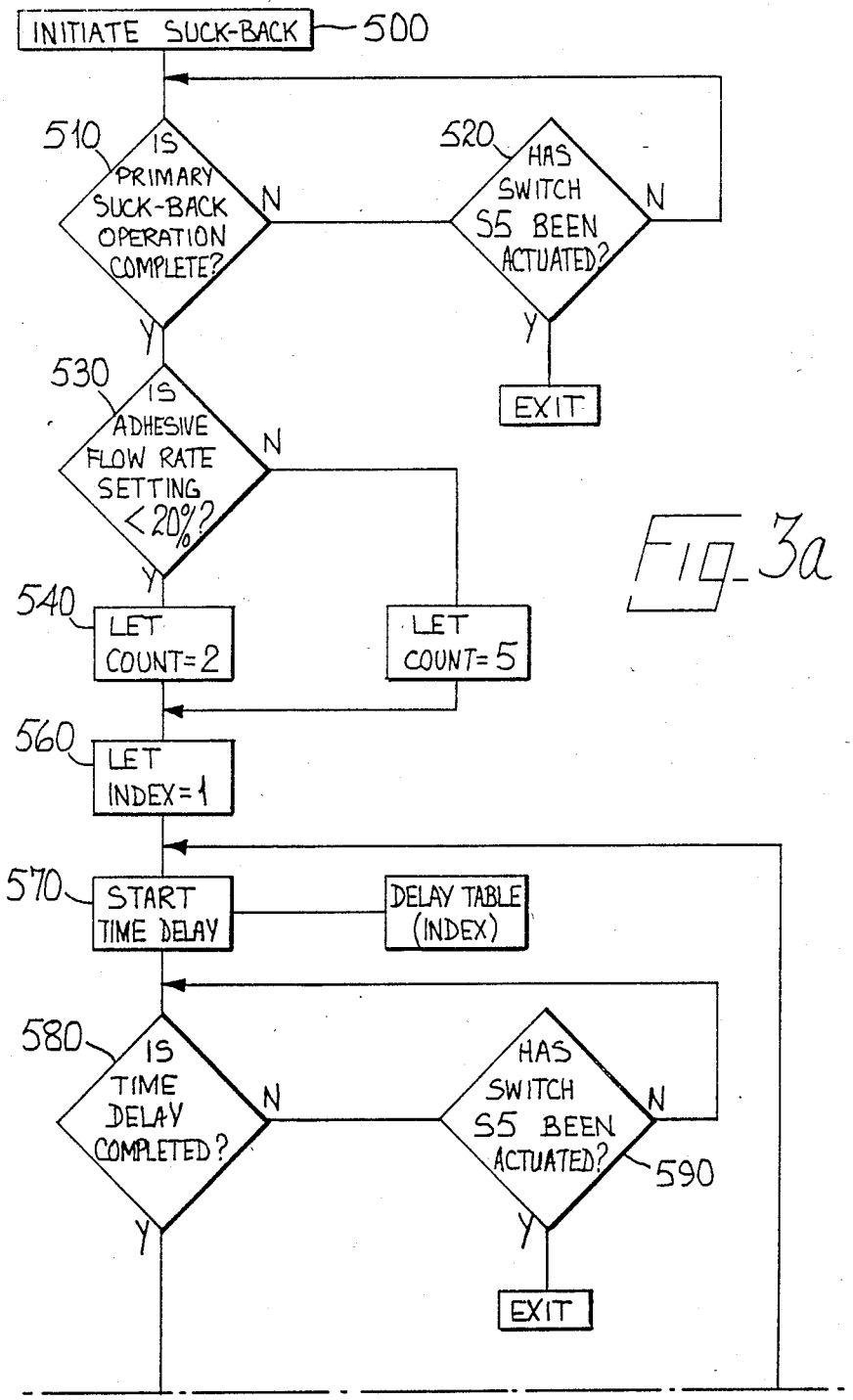
FIGS. 3*a* and 3*b* is a flow chart of a "suck-back control" programme forming part of control means of the system.
Figures 3B, 4, 5:
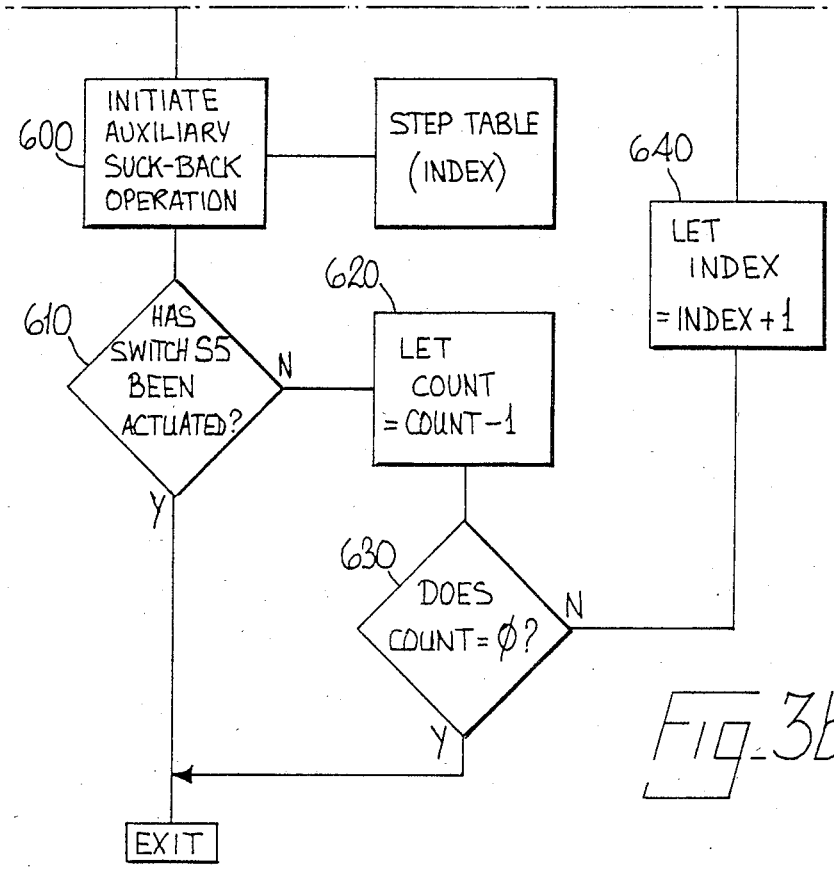
FIGS. 4 and 5 are diagrams showing look-up tables forming part of the programme shown in FIG. 3.

At the end of an operating cycle of the machine, it is regarded as desirable to avoid drooling of the adhesive from the passage in the creaser foot 22. This is achieved conventionally by a "suck back" arrangement. In the machine in accordance with the invention, "suck back" is initiated upon operation of the knee-operated switch S5 (the main function of which is to cause the supply of adhesive to be terminated), as will now be described in detail with reference to FIGS. 3 to 5.

In response to knee-operated switch S5 being switched to an "Adhesive Off" condition, thereby terminating the adhesive-applying operation, the "suck-back control" programme is executed, whereupon the motor drive is reversed and motor M is driven through a controlled distance (step 500) in an initial or primary suck-back step according to the operator-controlled setting of potentiometer VR5, which forms part of a "suck-back setting" circuit, the potentiometer having an adjustment knob 44 on the control panel 36. As already mentioned, the "suck back setting" circuit supplies a signal through the ADC so that the pre-determined distance can be varied according to operator preference. In the particular case, where a stepping motor is used to drive the gear pump 26, a range of 0 to 128 steps in the reverse direction has been found to be suitable, and the ADC serves to provide a "suck back" value in the range of 0 to 255 (0 to FF hex) in response to the setting of the potentiometer VR5.

This primary suck-back step is monitored during its execution (step 510) and also the status of knee-operated switch S5 is monitored (step 520) in the event that the primary suck-back step is not completed. Operation of switch S5 at this stage, indicating the start of a next adhesive-applying operation, discontinues the execution of the suck-back control programme.

When the primary suck-back step is completed, the increment value setting (potentiometer VR4) is scanned and also the status of switch S6 ("metering modify" circuit) and the proportion of the actual operation speed of the motor M (corresponding to the actual adhesive flow rate from the creaser foot 22) to the maximum motor operating speed (maximum flow rate) is computed (step 530). If this proportion is less than 20% then a "count" setting having a value "2" is made (step 540). If, on the other hand, the proportion is not less than 20%, then a "count" setting having a value "5" is made (step 550). An "index" setting having a value "1" is then also made (step 560).

A delay is then initiated (step 570), the length of the delay interval being determined according to a look-up table (FIG. 4) value corresponding to index value. During the delay interval the end of such interval is monitored (step 580) and also the status of knee-operated switch S5 is monitored (step 590) in the event that the delay interval has not yet come to an end. Operation of switch S5 at this stage, indicating the start of a next adhesive-applying operation, discontinues the execution of the suck-back control programme.

When the end of the delay interval is reached, a first auxiliary suck-back step is initiated (step 600), the amount of rotation of the motor M in the reverse direction (in casu the number of steps which the stepping motor executes in the reverse direction) being determined by reference to a look-up table (FIG. 5) for the value corresponding to the index value.

Following initiation of the first auxiliary step in this way, the status of knee-operated switch S5 is again monitored (step 610), switching said switch to an "Adhesive On" condition again discontinuing the execution of the suck-back control routine. If the switch S5 has not been so operated, the "count" value is reduced by "1" (step 620) and then is interrogated (step 630). If the count value equals zero, then the execution of the routine is terminated; if it is greater than zero, than the index value is increased by "1" (step 640) and the programme loops back to step 570, the looping continuing until either switch S5 is operated or the count value equals zero.

It will be observed that, with regard to the "delay interval" look-up table (FIG. 4), the earlier intervals are of shorter duration than the later ones and, with regard to the "suck-back amount" look-up table (FIG. 5), the amount in the earlier suck-back steps is greater than in the later. Also the variations in the two tables do not coincide. In this way the rate of suck-back gradually reduces as the adhesive in the creaser foot 22 approaches a stable temperature condition. It will of course be appreciated that the reverse steps of the motor M in the auxiliary suck-back steps are significantly smaller in number than in the primary suck-back operation.

In order, furthermore, to avoid a deficiency of adhesive at the start of the next following machine cycle, the motor M driving the gear pump 26 is actuated, upon actuation of the knee-operated switch S5, and operates through a pre-determined distance at a fast speed. The pre-determined distance may be the same as the primary "suck back" distance (as set by the operator using potentiometer VR5, or, if desired, may be a proportion (whether greater or smaller) of that distance. It is to be noted that, in order to prevent accidental switching on of the adhesive when the machine is not operating, the operation of the gear pump 26 at a fast speed is enabled as aforesaid only if the main drive shaft is rotating. More especially, the "fast speed" operation of the pump is initiated only after two pulses have been generated by the shaft encoder E.

As is also conventional in thermo-cementing and folding machines, the operation of the snipping knife arrangement 30 is controlled by solenoid SOL2, which is operated upon actuation of the treadle-operated switch S7.

It will be appreciated that, whereas the invention has been described above in relation to a thermo-cementing and folding machine of a "manual" type as described above, it is also applicable to machines of a so-called "automatic" type. In the later type of machine the switching on and off of adhesive is controlled by sensors, e.g. sensors of infra-red radiation emitted by an emitter, which sense a workpiece approaching the operating locality of the machine. In such machines instead of monitoring the status of knee-operated switch S5 as described above, it will be appreciated that the status of such sensors will instead be monitored.

It is furthermore to be appreciated that the disclosed adhesive supply system has been merely selected by way of exemplification of the present invention and not by way of limitation thereof and in particular is not to be understood as being restricted to use in thermo-cementing and folding machines.

We claim:

1. Adhesive supply system for hot melt adhesive, comprising a pump, a melt chamber in which adhesive is rendered molten, a nozzle through which molten adhesive is supplied from the melt chamber by means of the pump, and heating means for maintaining the nozzle at an appropriate temperature for ensuring that the adhesive in the nozzle remains molten not only during an adhesive-applying operation but also between successive such operations, means at the end of an adhesive-applying operation, for sucking back the molten adhesive in the nozzle so as to avoid drooling of adhesive from the nozzle, said sucking means including control means for initiating a primary suck-back operation and for thereafter allowing further auxiliary adhesive suck-back steps to take place through controlled distances which are spaced apart by pre-selected intervals starting at the end of the primary adhesive suck-back operation.

2. Adhesive supply system according to claim 1 wherein the number of auxiliary suck-back steps is determined according to the rate of delivery of the pump at the end of the adhesive-applying operation.

3. Adhesive supply system according to either of claims 1 or 2 wherein the distances through which auxiliary suck-back takes place as aforesaid are pre-set.

4. Adhesive supply system according to claim 1 wherein the initiation of each successive auxiliary suck-back step is timed from the end of the preceding suck-back step.

5. Adhesive supply system according to claim 1 wherein the later ones of the intervals by which the auxiliary suck-back steps are spaced apart are of greater duration than the earlier ones.

6. Adhesive supply system according to claim 1 wherein the controlled distances which take place as aforesaid in earlier auxiliary suck-back steps are greater than in later such steps.

7. Adhesive supply system for hot melt adhesive, comprising a reversible pump, a melt chamber in which adhesive is rendered molten, a nozzle through which molten adhesive is supplied from the melt chamber by means of the pump, and heating means for maintaining the nozzle at an appropriate temperature for ensuring that the adhesive in the nozzle remains molten not only during an adhesive-applying operation but also between successive such operations, operating means at the of an adhesive-applying operation, for operating the pump in reverse direction so as to cause the molten adhesive in the nozzle to be sucked back by a primary adhesive suck-back operation to avoid drooling of adhesive from the nozzle, said operating means including means for controlling the operation of the pump in reverse direction in a succession of auxiliary suck-back steps spaced apart by pre-selected intervals starting at the end of the primary adhesive suck-back operation.

8. Adhesive supply system according to claim 7 wherein the pump is driven by an n.c. motor and the control means comprises a computer control which serves to control the incidence of the operations of the motor in reverse direction and the duration of all such operation using appropriate look-up tables.

9. Adhesive supply syustem according to claim 8 wherein the computer control determines the number of operations of the motor in reverse direction according to the rate of operation of the pump at the end of the adhesive-applying operation.

* * * * *